United States Patent [19]

Yamane

[11] Patent Number: 4,973,509

[45] Date of Patent: Nov. 27, 1990

[54] IMAGE-RETRANSFER SHEET

[75] Inventor: Mitsuo Yamane, Yokkaichi, Japan

[73] Assignee: Brother Kogyo Kabushiki Kaisha, Aichi, Japan

[21] Appl. No.: 405,279

[22] Filed: Sep. 11, 1989

[30] Foreign Application Priority Data

| | | | |
|---|---|---|---|
| Sep. 12, 1988 | [JP] | Japan | 63-227856 |
| Sep. 19, 1988 | [JP] | Japan | 63-234451 |
| Sep. 19, 1988 | [JP] | Japan | 63-234452 |
| Sep. 19, 1988 | [JP] | Japan | 63-234454 |
| Sep. 19, 1988 | [JP] | Japan | 63-234455 |
| Sep. 19, 1988 | [JP] | Japan | 63-234456 |

[51] Int. Cl.[5] ..... B41M 3/12

[52] U.S. Cl. ..... 428/195; 156/235; 428/327; 428/447; 428/484; 428/488.1; 428/488.4; 428/522; 428/523; 428/913; 428/914

[58] Field of Search ..... 8/471; 428/195, 323, 428/484, 488.1, 913, 914, 327, 447, 488.4, 522, 523; 503/227; 156/235

[56] References Cited

U.S. PATENT DOCUMENTS 4,778,729 10/1988 Mizobuchi ..... 428/484

*Primary Examiner*—Pamela R. Schwartz
*Attorney, Agent, or Firm*—Oliff & Berridge

[57] ABSTRACT

An image-retransfer sheet for dry-processing type image-transferring materials having an image produced by a heat-sensitive transferring method is disclosed, which comprises a substrate having on one surface thereof a layer of a surface treating agent having elongation of at least 100%.

8 Claims, 1 Drawing Sheet

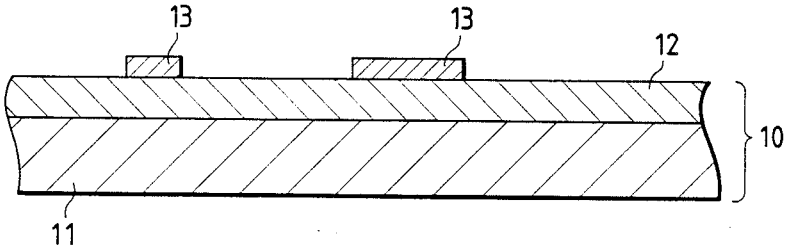
13
13
12
10
11

IMAGE-RETRANSFER SHEET

FIELD OF THE INVENTION

The present invention relates to an image-retransfer sheet to which letters, symbols, figures, etc. are thermally printed and from which the thermally transferred letters, symbols, figures, etc. are retransferred onto a surface of an image-receiving material with pressure, more specifically to an image-retransfer sheet which is a base sheet for an image-transferring material having an image provided by printing letters, symbols, figures, etc. using a heat sensitive image transferring type printer, typewriter, word processor or the like.

BACKGROUND OF THE INVENTION

Hitherto, instant lettering has been performed with an image-transferring material having printed thereon images such as letters, figures and indicia which are brought into contact with a surface of an image-receiving material and transferred thereto by applying pressure under dry condition. As a base sheet of such an image-transferring material (hereafter referred to as "dry-processing type image-transferring material"), transparent or semi-transparent plastic films or those having repelable coatings provided thereon are used. A conventional dry-processing type image-transferring material comprises a base sheet having thereon an image printed by screen-printing and further thereon a pressure-sensitive adhesive layer, with which the printed image is transferred to a image-receiving material which is brought into contact with the image-transferring material.

A base sheet for dry-processing type image-transferring materials which have an image printed by a thermally image-transferring process is described in JP-A-63 128987 (the term "JP-A" used means an unexamined and published Japanese patent application), wherein plastic films (e.g., a polyethylene film, a polypropylene film and a fluorine-containing resin film) having a smooth surface and exhibiting a contact angle with water of at least 95°, and paper, metal foils or plastic films having a coating of a silicone resin are used as the base sheet.

In order to thermally print an image onto a base sheet having a contact angle with water of at least 95° and particularly not less than 105° it is necessary to reduce surface tension of ink to wet the sheet and further necessary to increase adhesion between the ink and the sheet more than cohesive force of the ink and adhesion between the ink and a sheet of an ink-releasing sheet such as polyethylene terephthalate film. For the purpose, the ink temperature must be increased when the image is thermally printed, requiring high energy to be applied to a thermally image-transferring device, which is disadvantageous in view of durability of a thermal head and load on a power supply.

Further an image thermally printed on the base sheet having poor wetability is easily retransferred with slight pressure due to weak adhesion to the base sheet, and a portion of the image which is desired to be left on the base sheet may unwillingly be retransferred, causing stains on an image-receiving material. Such easy transfer is troublesome in handling of the sheet.

Furthermore, since the base sheet has an extremely small static friction coefficient, the sheet is not easily fixed during retransfer of the thermally printed image from the sheet to an image-receiving material, so that the image is retransferred on an undesired portion of the image-receiving material or distorted on the image-receiving material.

Japanese Patent Application No. 62-80127 discloses formation of a sticky layer apart from a thermally printed image on a base sheet so as to prevent the sheet from moving during retransfer of the image with pressure. However, the formation of a sticky layer on a certain portion of the base sheet necessitates a specific means in production and an exclusive device therefor, requiring large costs. Further, the sticky layer has to be covered with a separable sheet before use, i.e., before the image-retransfer step, which requires additional means and costs. Moreover, in the case of a base sheet having a repelable coating of a silicone resin, the base sheet is coated twice for the repelable coating and the sticky layer, and regardless of coating order of the two, the later coating may have chance to be affected by the previous coating.

That is, when a silicone resin is first coated on the sheet, the subsequent coating of a sticky composition is repelled. When the sticky composition is first coated, on the other hand, the silicone resin is coated only with difficulty because of stickiness of the previous coating. If the sticky layer is covered with a separable sheet, then the thickness of the resulting sheet partially increases so that the silicone resin cannot easily be coated. Even if the above processing works to properly coat the silicone resin, since the sticky layer is provided only at a certain portion of the sheet and not around images thermally printed on the sheet, the sheet still moves during the image-retransfer step resulting in formation of imperfect images on the image-receiving material.

SUMMARY OF THE INVENTION

The first object of the present invention is to provide an image-retransfer sheet which is easily fixed during the image-retransfer step.

The second object of the present invention is to provide an image-retransfer sheet capable of retaining a thermally printed ink image thereon even when slightly rubbed or applied pressure thereto.

The third object of the present invention is to provide an image-retransfer sheet capable of receiving an ink image of good quality by thermal printing with low energy.

The fourth object of the present invention is to provide an image-retransfer sheet which exhibits strong adhesion with an ink image as compared to conventional image-retransfer sheets, yet providing a retransferred image with good quality.

The fifth object of the present invention is to provide an image-retransfer sheet which can contain a material having good wetability (a contact angle with water of 80° or less) in a layer of a surface treating agent formed on the sheet, yet providing a retransferred image with good quality.

The sixth object of the present invention is to provide an image-retransfer sheet having a layer of a surface treating agent wetability of which can be adjusted, so that a retransferred image of good quality can be provided even when strength of the energy to be applied for thermal printing of an ink image is varied.

The seventh object of the present invention is to provide an image-retransfer sheet having a layer of a surface treating agent which can be easily dried at low temperature and for a short period of time.

The eighth object of the present invention is to provide an image-retransfer sheet having a layer of a surface treating agent which is easily formed without adverse influence such as offset of the surface treating agent onto another sheet and without difficulty in cleaning of tools used for preparation and coating of the surface treating agent.

The ninth object of the present invention is to provide an image-retransfer sheet having a layer of a surface treating agent which can be formed leaving out of consideration with respect to solubility, compatibility of the surface treating gent with other components used together, etc.

The above objects have been attained by an image-retransfer sheet having on one surface thereof a layer of a surface treating agent which has elongation of at least 100% and optionally contains a wetability controlling agent selected from the group consisting of silicone compounds, fluorine-containing compounds, wax and polyethylene fine powder.

BRIEF DESCRIPTION OF THE DRAWINGS

The figure illustrates a sectional view of an image-retransfer sheet of the present invention having an ink image thereon.

DETAILED DESCRIPTION OF THE INVENTION

As shown in the figure, image-retransfer sheet 10 of the present invention comprises substrate 11 having layer 12 of a surface treating agent (hereafter referred to as "surface treating layer").

The substrate 11 preferably has a thickness of from 25 to 200 microns and more preferably from 50 to 150 microns. Further it is preferred that the substrate 11 not only have a mechanical strength sufficient to be handled in production of the image-retransfer sheet 10 but also have flexibility to such an extent that pressure can easily act upon ink image 13 on the sheet during the step of retransferring the image with pressure and that a dry processing type image-transferring material can be easily produced by thermally printing on the sheet.

However, a substrate which exhibits too large elongation is not preferred as the substrate is stretched too much when applied pressure for retransfer of the ink image 13, causing distortion of the image. The substrate 11 preferably has elongation of not more than 200%.

To ensure retransfer of the ink image 13 precisely onto an image-receiving material with pressure, the substrate 11 is preferably transparent or semi-transparent, and semitransparent substrates are particularly preferred since it is easy to check whether or not the ink image 13 is completely retransferred from the image-retransfer sheet 10.

Examples of the substrate 11 having the above properties include paper, metal foil, and plastic films such as fluorine-based films of fluorine containing resins (e.g., ethylene/tetrafluoroethylene copolymer and tetrafluoroethylene/hexafluoroethylene copolymer), films of polyethylene, polypropylene, polyethylene terephthalate nylon, polyimide, polyvinyl chloride, polycarbonate polysulfone, ethylene/vinyl acetate copolymer, acrylonitrile/butadiene/styrene copolymer or ionomer, and the like.

The surface treating layer 12 which is formed on a surface of the substrate 11 preferably has a static friction coefficient of at least 0.25, more preferably at least 0.3 so as to prevent the image retransfer sheet 10 from moving during retransfer of the ink image 13 on the sheet to an image-receiving material, thereby making it possible to form a precise retransferred image on the image-receiving material.

Further, the surface treating layer 12 preferably has a contact angle with water of from 80° to 120°, more preferably from 80° to 110°, whereby the adhesion between the ink image 13 and the image-retransfer sheet 10 can be increased to leave desired portions of the image 13 on the sheet 10 even with a slight pressure applied thereto. Thus, the resulting sheet 10 is convenient to handle.

For printing a large image onto an image-retransfer sheet using a heat-sensitive image-transferring device with a serial type small head, it has hitherto been needed to print the large image in parts such a manner that portions of the image are printed to slightly overlap each other, so that the partial print of the image is often scratched by the head upon subsequent printing of another portion of the image. Therefore, the image is divided line after line and thermally printed to the sheet with a little space therebetween to avoid scratching with the head, and each of the devided partial images printed is then retransferred subsequently to put together on an image-receiving material. Use of the image-retransfer sheet of the present invention, however, makes it possible to thermally print a large image as such because of the moderate adhesion as described above.

Further, since the image-retransfer sheet 10 exhibits good wetability and moderate adhesion, an image can be thermally printed to the sheet with low energy and the image quality becomes good.

According to the present invention, the surface treating layer 12 has elongation of at least 100%. Since only the layer is stretched upon retransfer of an image carried on the sheet with pressure, the adhesion between the image and the sheet is weaken at that time, whereby the sheet exhibits good image retransferring property, yet having good wetability and adhesion with the image.

The surface treating layer 12 of the present invention is mainly composed of one or more of surface treating agents exemplified with polyethylene, ethylene/vinyl acetate copolymer, ethylene/ethyl acrylate copolymer, ethylene/acrylic acid copolymer, ionomer, ethylene/-methacrylic acid copolymer, a silicone, etc. Of these, polyethylene and ethylene/vinyl acetate copolymer are particularly preferred.

In the case of using materials having good wetability (a contact angle with water of less than 80°) as a surface treating agent, which impart elongation property and are advantageous in production of image-retransfer sheet, however, the image-retransferring property of the resulting sheet is deteriorated due to the wetability of the surface treating layer. The image-retransferring property also becomes poor when an ink image is thermally formed on the sheet with increased energy as the adhesion between the ink image and the surface treating layer increases. According to the present invention, however, such materials can be used in the surface treating layer 12 if used together with a compound selected from silicone compounds, fluorine-containing compounds, wax or polyethylene fine powder which can control the wetability of the surface treating layer 12 within the range of from 80° to 120° in terms of contact angle with water by adjusting its addition amount.

The silicone compounds may be any type, either oils, rubbers or resins, as long as they are organic silicone compounds having a contact angle with water of at least 80°. One or more silicone compounds may be incorporated in the surface treating layer. In particular, a silicone oil (a low molecular weight silicone compound) is preferably used with a silicone resin (a high molecular weight silicone compound) since the silicone oil improves compatibility of the silicone resin with other components of the surface treating layer 12 to form a uniform and smooth surface treating layer.

The silicone compound is generally added in an amount of from 0.01 to 50 parts by weight per 100 parts by weight of the surface treating agent. If the silicone compound has elongation of 100% or more when coated in the form of layer, it may be added in an amount of from 0.01 to 100 parts by weight. When a silicone oil and a silicone resin are used in combination, they may be added in amounts of from 0.01 to 50 parts by weight, respectively.

As the fluorine containing compounds, there may be used any fluorine-based organic compounds having a contact angle with water of at least 80°, such as surfactants and surface reforming agents. They may be used independently or as a mixture thereof. The fluorine-containing compound is generally added in an amount of from 0.01 to 50 parts by weight per 100 parts by weight of the surface treating agent. A fluorine containing compound having elongation of 100% or more when coated in the form of layer may be added up to 100 parts by weight.

Examples of the wax include natural wax (e.g., animal wax, vegetable wax and mineral wax) and synthetic wax (e.g., petroleum wax, coal wax, polyethylene wax and fats-and-oils type wax). Petroleum wax, polyethylene wax, fats-and-oils type wax and Fischer-Tropsch wax commonly used as a lubricant are preferably used, and petroleum wax, polyethylene wax and Fischer-Tropsch wax which have a contact angle with water of at least 80° are particularly preferred. The amount of wax added is generally from 0.01 to 50 parts by weight per 100 parts by weight of the surface treating agent.

Further, the polyethylene fine powder is generally added in an amount of from 0.01 to 50 parts by weight per 100 parts by weight of the surface treating agent, and a polyethylene fine powder which has elongation of 100% or more when coated in the form of layer may be added in an amount of from 0.01 to 90 parts by weight.

By use of the above-described wetability controlling agent in combination, materials having a contact angle with water of less than 80° which have not been used can be used as a surface treating agent in the present invention.

The surface treating layer 12 can be formed on the substrate 11 in a conventional manner. In the case of adding a silicone compound in the surface treating layer, the coating composition for the surface treating layer is coated on the substrate 11, followed by heating at a temperature of higher than 100° C. for at least 30 seconds for curing. On the other hand, coating compositions using a fluorine-containing compound, wax or polyethylene fine powder can be dried at low temperature (lower than 100° C.) for a short period of time (less than 30 seconds), and thus their use can reduce production costs of image-retransfer sheets and is preferred.

While the wetability controlling agents are effectively used to form the surface treating layer 12 having well-balanced properties with respect to adhesion with an ink image and image-retransferring property, the wax and the polyethylene fine powder are particularly preferably used since the coating composition containing the wax or polyethylene fine powder does not form a rigid thin film on a surface of tools used for preparation and coating of the composition as experienced in the case of using the silicone compounds or fluorine containing compounds, and the tools can easily be cleaned and used for other purposes without problems such as repelling, etc. Further the resulting coated layer using the wax or polyethylene fine powder is easily dried and is free from offset onto the back surface of the sheet when piled. Furthermore, the wax and the polyethylene fine powder can be easily dispersed in the coating composition regardless of their solubility in solvents and compatibility with other components of the surface treating layer 12, and thus their use is very advantageous in selection of materials for the surface treating layer 12 and production of the image-retransfer sheet 10.

By providing the surface treating layer 12 of the present invention an image-retransfer sheet having good property of receiving a thermally printed image, image-retransferring property and resistance to friction, moderate adhesion to a thermally printed image and good fixability during retransfer of images can be obtained.

Any ink ribbon conventionally used in a heat-sensitive image-transferring type printer, typewriter, word processor, etc. may be used for thermally forming an image on the image-retransfer sheet 12 of the present invention. Ink ribbons may be those have a coating of ink mainly composed of wax and preferably those having a layer of controlling image-transferring properties and an ink layer. The former layer is provided on the latter layer as a top coating and has high heat-sensitive adhesion, hardness, viscosity and cohesion, as compared to the latter layer, whereby thermally transferring property of the ink ribbon, particularly to an image-retransfer sheet having poor wetability, is enhanced. These layers of the image thermally transferred on an image-retransfer sheet are retransferred together onto an image-receiving material when applied pressure. If pressure-sensitive adhesive property is imparted to the ink layer, pressure sensitive image-retransferring property can further be improved.

The present invention is further explained in detail with reference to the following Examples and Comparative Examples, but the present invention is not construed as being limited thereto. In the Examples and Comparative Examples, all parts are by weight.

EXAMPLE 1

The following coating composition was coated on a 50 micron thick polyethylene terephthalate film to form a smooth surface treating layer having a contact angle with water of 85° to 90°, a static friction coefficient of about 0.45 and elongation of 600%.

Coating Composition for Surface Treating Layer:

Ethylene/vinyl acetate copolymer

| | |
|---|---|
| ( EVAFLEX420, produced by Mitsui Du Pont Polychemical Co., Ltd.) | 10 parts |
| Toluene | 90 parts |

Onto the thus prepared image-retransfer sheet was thermally transferred an ink using a heat sensitive transferring type word porcessor ("NP 5100", produced by Brother Industries, Ltd.), whereby a dry-processing type image-transferring material having an ink image of good quality could be obtained with less thermal energy than that using a conventional image-retransfer sheet. When the image on the dry-processing type image-transferring material was retransferred to an image-receiving material such as paper and plastic articles by applying pressure thereto, a clear retransferred image was formed on the image-receiving material. The dry-processing type image transferring material hardly moved when applied pressure, so that it was easy to obtain a good retransferred image.

When the thickness of the surface treating layer was changed to 1, 3 and 5 microns, it was found that the image retransferring property of the resulting sheet becomes better as the thickness increases. It is believed to be because the thicker surface treating layer has larger elongation in absolute quantity.

EXAMPLE 2

The following coating composition was coated on a 100 micron-thick nylon film to form a smooth surface treating layer having a contact angle with water of 85° to 90°, a static friction coefficient of about 0.45 and elongation of 600%.

Coating Composition for Surface Treating Layer:

Ethylene/vinyl acetate copolymer

| | |
|---|---|
| ("Chemipearl V-200", produced by Mitsui Petrochemical Industries, Ltd) | 100 parts |

Using the thus prepared image-retransfer sheet, a dry processing type image-transferring material was produced in the same manner as in Example 1 and subjected to pressure sensitive image-retransferring processing. As a result, a clear retransferred image was formed on an image receiving material.

EXAMPLE 3

The following coating composition was coated on a 50 micron-thick polypropylene film to form a surface treating layer having a contact angle with water of 87° to 90°, a static friction coefficient of about 0.32 and elongation of 650%.

Coating Composition for Surface Treating Layer:

Ethylene/vinyl acetate copolymer

| | |
|---|---|
| ("EVAFLEX640", produced by Mitsui Du Pont Polychemical Co., Ltd.) | 10 parts |
| Toluene | 90 parts |

Using the thus prepared image-retransfer sheet a dry processing type image-transferring material was produced in the same manner as in Example 1 and subjected to pressure sensitive image-retransferring processing. As a result, a clear retransferred image was formed on an image-receiving material.

COMPARATIVE EXAMPLE 1

A dry-processing type image-transferring material was prepared in the same manner as in Example 3, except that a 100 micron thick high density polyethylene film having elongation of 500 was used as a substrate. When the image-transferring material was subjected to pressure sensitive image-transferring processing, the film stretched at the portion to which pressure was applied, causing distortion of the image thereon. As a result, a clear retransferred image was not formed on an image-receiving material.

COMPARATIVE EXAMPLE 2

The following coating composition was coated on a 50 micron-thick polyethylene terephthalate film to form a smooth surface treating layer having a contact angle with water of 110° to 120°, a static friction coefficient of about 0.21 and elongation of 0%.

Coating Composition for Surface Treating Layer:

| | |
|---|---|
| Silicone ("KS 841", produced by Shin Etsu Chemical Co., Ltd.) | 10 parts |
| Hardening agent ("PL 8", produced by Shin Etsu Chemical Co., Ltd.) | 0.3 parts |
| Toluene | 90 parts |

The thus prepared image-retransfer sheet had poor wetability, so that high energy was needed to print an image thereon using a hear sensitive transferring device, and the printed image did not have good image quality and was easily removed by rubbing because of poor adhesion to the sheet. Further, since the sheet had a small static friction coefficient, the sheet was not easily fixed during retransfer of the image and the image was distorted on an image-receiving material or retransferred in an improper position thereof.

COMPARATIVE EXAMPLE 3

The following coating composition was coated on a 50 micron-thick polyethylene terephthalate film to form a smooth surface treating layer having a contact angle with water of 74° to 78°, a static friction coefficient of about 0.75 and elongation of 350%.

Coating Composition for Surface Treating Layer:

| | |
|---|---|
| Ionomer resin ("Chemipearl SA 100", produced by Mitsui Petrochemcal Industries, Ltd.) | 100 parts |

The thus prepared image-retransfer sheet had good wetability, so that an ink image thermally transferred was strongly adhered on the surface treating layer and the ink image could not be completely retransferred from the layer to an image-receiving material when applied pressure.

COMPARATIVE EXAMPLE 4

The following coating composition was coated on a 50 micron-thick polyethylene terephthalate film to form a smooth surface treating layer having a contact angle with water of about 100°, a static friction coefficient of about 0.25 and elongation of 0%.

Coating Composition for Surface Treating Layer:

| | |
|---|---|
| Silicone ("KR-251", produced by Shin Etsu Chemical Co., Ltd.) | 100 parts |

The thus prepared image-retransfer sheet had moderate wetability but lack of elongation, so that an ink image thermally transferred was not completely retransferred onto an image-receiving material and remained on the surface treating layer.

EXAMPLE 4

The following coating composition was coated on a 50 micron-thick polyethylene terephthalate film to form a smooth surface treating layer having a contact angle with water of 103° to 104°, a static friction coefficient of about 0.37 and elongation of 650%.

Coating Composition for Surface Treating Layer:

Ethylene/vinyl acetate copolymer

| | |
|---|---|
| ("EVAFLEX640", produced by Mitsui Du Pont Polychemical Co., Ltd.) | 10 parts |
| Silicone ("KP 358", produced by Shin-Etsu Chemical Co., Ltd.) | 0.1 part |
| Toluene | 90 parts |

Using the thus prepared image-retransfer sheet, a dry processing type image-transferring material was produced in the same manner as in Example 1 and subjected to pressure sensitive image-retransferring processing. As a result, a clear retransferred image was formed on an image-receiving material.

When an ink image was thermally printed on the image-retransfer sheet using a thermal head with energy of 25 mj/mm$^2$, the energy was too much so that the adhesion between the ink image and the surface treating layer was too large to retransfer the ink image with good quality onto an image-receiving material. With energy of 23 mj/mm$^2$, on the other hand, both a thermally printed ink image and a retransferred ink image were provided with good quality on the image-retransfer sheet and the image-receiving material, respectively. By changing the added amount of the silicone compound from 1% to 3%, the contact angle with water of the surface treating layer was changed to 105°-107°. As a result, a retransferred ink image of good quality could be provided on an image-receiving material even with energy of 25 mj/mm$^2$ for thermally printing an ink image on the image-retransfer sheet. This result shows that both a thermally printed ink image and a retransferred ink image can be provided with good quality on the image-retransfer sheet and the image-receiving material, respectively, by changing the added amount of the silicone compound corresponding to the energy applied to the thermal head.

EXAMPLE 5

The following coating composition was coated on a 100 micron-thick nylon film to form e smooth surface treating layer having a contact angle with water of 85° to 90°, a static friction coefficient of about 0.45 and elongation of 440%.

Coating Composition for Surface Treating Layer:

| | |
|---|---|
| Acryl/colloidal silica ("VONCOAT DV 767", produced by DAINIPPON INK & CHEMICALS, INC.) | 100 parts |
| Silicone ("KP-316", produced by Shin-Etsu Chemical Co., Ltd.) | 3 parts |

Using the thus prepared image-retransfer sheet, a dry processing type image-transferring material was produced in the same manner as in Example 4 and subjected to pressure sensitive image-retransferring processing. As a result, a clear retransferred image was formed on an image-receiving material.

The acryl/colloidal silica has a contact angle with water of 50°. The result of this Example proves that by incorporating a silicone compound together, a material having a contact angle with water of less than 80° can be used as a surface treating agent to form a surface treating layer having the contact angle of 80° to 20° which can provide a retransferred image with good quality on an image receiving material.

EXAMPLE 6

The following coating composition was coated on a 50 micron thick polypropylene film to form a surface treating layer having a contact angle with water of 108° to 110°, a static friction coefficient of about 0.36 and elongation of 650%.

Coating Composition for Surface Treating Layer:

| | |
|---|---|
| Ethylene/vinyl acetate copolymer ("EVAFLEX640", produced by Mitsui Du Pont Polychemical Co., Ltd.) | 100 parts |
| Silicone ("KS 841", produced by Shin-Etsu Chemical Co., Ltd.) | 1 part |
| Hardening agent ("PL 8", produced by Shin-Etsu Chemical Co., Ltd.) | 0.03 parts |
| Toluene | 900 parts |

Using the thus prepared image-retransfer sheet, a dry processing type image-transferring material was produced in the same manner as in Example 4 and subjected to pressure sensitive image-retransferring processing. As a result, a clear retransferred image was formed on an image-receiving material.

EXAMPLE 7

The following coating composition was coated on a 50 micron-thick polyethylene terephthalate film to form a smooth and uniform surface treating layer having a contact angle with water of 105° to 108°, a static friction coefficient of about 0.36 and elongation of 650%. The drying condition of the coated layer was at 110° C. for 60 seconds.

Coating Composition for Surface Treating Layer:

| | |
|---|---|
| Ethylene/vinyl acetate copolymer ("EVAFLEX640", produced by Mitsui Du Pont Polychemical Co., Ltd.) | 100 parts |
| Silicone ("KS 841", produced by Shin-Etsu Chemical Co., Ltd.) | 2.5 parts |
| Hardening agent ("PL 8", produced by Shin-Etsu Chemical Co., Ltd.) | 0.08 parts |
| Silicone ("KP 358", produced by Shin-Etsu Chemical Co., Ltd.) | 1 part |
| Toluene | 900 parts |

Using the thus prepared image-retransfer sheet, a dry processing type image-transferring material was produced in the same manner as in Example 1 and subjected to pressure sensitive image-retransferring processing. As a result, a clear retransferred image was formed on an image-receiving material.

When an ink image was thermally printed on the image-retransfer sheet using a thermal head with energy of 28 mj/mm$^2$, the energy was too much, so that adhesion between the ink image and the surface treating layer was too large to retransfer the ink image of good quality onto an image-receiving material. With energy of 25 mj/mm$^2$, on the other hand, both a thermally printed image and a retransferred image were provided with good quality on the image-retransfer sheet and the image-receiving material, respectively. By changing the added amount of the silicone compound from 2.5 to 10%, the surface treating layer had a contact angle with water of 110°, whereby a retransferred image of good quality could be formed on the image-receiving material even with the energy of 28 mj/mm$^2$ for thermally printing an ink image on the image-retransfer sheet. The result shows that both a thermally printed image and a retransferred image can be provided with good quality on the image-retransfer sheet and the image-receiving material, respectively, by changing the added amount of the silicone compound corresponding to the energy applied to the thermal head.

EXAMPLE 8

The following coating composition was coated on a 50 micron-thick polyethylene terephthalate film to form a 5 micron-thick smooth surface treating layer having a contact angle with water of 103° to 104°, a static friction coefficient of about 0.50 and elongation of 650%. The drying condition of the coated layer was at 80° C. for 20 seconds.

Coating Composition for Surface Treating Layer:

| | |
|---|---|
| Ethylene/vinyl acetate copolymer ("EVAFLEX640", produced by Mitsui Du Pont Polychemical Co., Ltd.) | 10 parts |
| A-B Blockpolymer containing a fluorinated alkyl group ("Modiper F310", produced by Nippon Fats And Oils Co., Ltd.) | 0.5 parts |
| Toluene | 90 parts |

Using the thus prepared image-retransfer sheet, a dry processing type image-transferring material was produced in the same manner as in Example 1 and subjected to pressure sensitive image retransferring processing. As a result, a clear retransferred image was formed on an image-receiving material.

When an ink image was thermally printed on the image-retransfer sheet using a thermal head with energy of 27 mj/mm$^2$, the energy was too much, so that adhesion between the ink image and the surface treating layer was too large to retransfer the ink image of good quality onto an image-receiving material. With energy of 25 mj/mm$^2$, on the other hand, both a thermally printed image and a retransferred image were provided with good quality on the image-retransfer sheet and the image-receiving material, respectively. By changing the added amount of the fluorine-containing compound from 5 to 10%, the surface treating layer had a contact angle with water of 105°–107°, whereby a retransferred image of good quality could be formed on the image-receiving material even with the energy of 27 mj/mm$^2$ for thermally printing an ink image on the image-retransfer sheet. The result shows that both a thermally printed image and a retransferred image can be provided with good quality on the image-retransfer sheet and the image-receiving material respectively, by changing the added amount of the fluorine-containing compound corresponding to the energy applied to the thermal head.

EXAMPLE 9

The following coating composition was coated on a 100 micron-thick nylon film to form a thin smooth surface treating layer having a contact angle with water of 104° to 105°, a static friction coefficient of about 0.45 and elongation of 440%. The drying condition of the coated layer was the same as in Example 8.

Coating Composition for Surface Treating Layer:

| | |
|---|---|
| Ethylene/vinyl acetate copolymer ("EVAFLEX640", produced by Mitsui Du Pont Polychemical Co., Ltd.) | 10 parts |
| A-B Blockpolymer containing a fluorinated alkyl group ("Modiper FT1263", produced by Nippon Fats And Oils Co., Ltd.) | 0.5 parts |
| Toluene | 90 parts |

Using the thus prepared image-retransfer sheet, a dry processing type image-transferring material was produced in the same manner as in Example 8 and subjected to pressure sensitive image retransferring processing. As a result, a clear retransferred image was formed on an image-receiving material.

EXAMPLE 10

The following coating composition was coated on a 50 micron-thick polyethylene terephthalate film to form a 5 micron-thick smooth surface treating layer having a contact angle with water of 93°, a static friction coefficient of about 0.43 and elongation of 600%. The drying condition of the coating was at 80° C. for 20 seconds.

Coating Composition for Surface Treating Layer:

| | |
|---|---|
| Ethylene/vinyl acetate copolymer ("EVAFLEX640", produced by Mitsui Du Pont Polychemical Co., Ltd.) | 9 parts |
| Polyethylene wax ("High Wax 100P", Mitsui Petrochemical Industries, Ltd.) | 1 part |
| Toluene | 90 parts |

While solubitity and compatibility of the wax were not necessarily taken into consideration, the coating composition could be well dispersed merely with a ballmill and the coating composition was prepared and coated without any difficulty.

Using the thus prepared image-retransfer sheet a dry processing type image-transferring material was produced in the same manner as in Example 1 and subjected to pressure sensitive image-retransferring processing. As a result, a clear retransferred image was formed on an image-receiving material.

It was also found that both a thermally printed image and a retransferred image can be provided with good quality on the image-retransfer sheet and the image-receiving material, respectively, by changing the added amount of the wax corresponding to the energy applied to the thermal head.

Tools used in preparation and coating of the coating composition were easily cleaned using toluene and could be used for other purposes thereafter.

EXAMPLE 11

The following coating composition was coated on a 50 micron-thick polyethylene terephthalate film to form a 5 micron thick smooth surface treating layer having a contact angle with water of 95° a static friction coefficient of the coated layer was at 80° C. for 20 seconds.

Coating Composition for Surface Treating Layer:

| | |
|---|---|
| Ethylene/vinyl acetate copolymer ("EVAFLEX640", produced by Mitsui Du Pont Polychemical Co., Ltd.) | 9 parts |
| Polyethylene fine powder ("Flobeads LE 1080", produced by Seitetsu Kagaku Co., Ltd.) | 1 part |
| Toluene | 90 parts |

While solubitity and compatibility of the polyethylene fine powder were not necessarily taken into consideration, the coating composition could be well dispersed merely with a ballmill and the coating composition was prepared and coated without any difficulty.

Using the thus prepared image-retransfer sheet, a dry processing type image-transferring material was produced in the same manner as in Example 1 and subjected to pressure sensitive image-retransferring processing. As a result, a clear retransferred image was formed on an image-receiving material.

It was also found that both a thermally printed image and a retransferred image can be provided with good quality on the image-retransfer sheet and the image-receiving material, respectively, by changing the added amount of the polyethylene fine powder corresponding to the energy applied to the thermal head.

Tools used in preparation and coating of the coating composition were easily cleaned using toluene and could be used for other purposes thereafter.

While the invention has been described in detail and with reference to specific embodiments thereof, it will be apparent to one skilled in the art that various changes and modifications can be made therein without departing from the spirit and scope thereof.

What is claimed is:

1. An image-retransfer sheet for dry-processing type image-transferring materials comprising:

a substrate;

a layer of a surface treating agent coated on one surface of said substrate, said surface treating agent having an elongation of at least 100%; and a discontinuous transferable image on a surface of the surface treating agent not adjacent said substrate, said transferable image for transfer to a further object by the application of pressure to a back side of said substrate.

2. An image-retransfer sheet as in claim 1, wherein said layer of a surface treating agent contains an ethylene vinyl acetate copolymer.

3. An image-retransfer sheet as in claim 1, wherein said layer of a surface treating agent contains polyethylene.

4. An image-retransfer sheet as in claim 1, wherein said layer of a surface treating agent has a static friction coefficient of at least 0.25 and a contact angle with water of from 80° to 120°.

5. An image-retransfer sheet as in claim 1, wherein said layer of a surface treating agent contains at least one wetability controlling agent selected from the group consisting of silicone compounds, fluorine-containing compounds, wax, and polyethylene fine powder.

6. An image-retransfer sheet as in claim 1, wherein said layer of a surface treating agent contains a wetability controlling agent comprising a silicone resin and a silicone oil.

7. An image-retransfer sheet as in claim 1, wherein said transferable image is placed on said surface of said layer of a surface-treating agent by a heat-sensitive transferring method.

8. An image-retransfer sheet for dry-processing type image-transferring materials having a transferable image produced thereon by a heat-sensitive transferring method, the image-retransfer sheet comprising a substrate having on one surface a layer of surface treating agent having elongation of at least 100%, the layer of surface treating agent containing a wetability controlling agent which comprises a silicone resin and a silicone oil.

* * * * *